US007097685B2

(12) United States Patent
Miura et al.

(10) Patent No.: US 7,097,685 B2
(45) Date of Patent: Aug. 29, 2006

(54) CEMENTED CARBIDE, COATED CEMENTED CARBIDE MEMBER AND PRODUCTION PROCESSES OF THE SAME

(75) Inventors: Hiroyuki Miura, Kawasaki (JP); Satoshi Kinoshita, Kawasaki (JP)

(73) Assignee: Tungaloy Corporation, Kawasaki (JP)

( * ) Notice: Subject to any disclaimer, the term of this patent is extended or adjusted under 35 U.S.C. 154(b) by 0 days.

(21) Appl. No.: 10/924,872

(22) Filed: Aug. 25, 2004

(65) Prior Publication Data

US 2005/0019614 A1 Jan. 27, 2005

(51) Int. Cl.
*B22F 3/00* (2006.01)
*B22F 7/02* (2006.01)
*C22C 29/02* (2006.01)

(52) U.S. Cl. ..... 75/236; 75/240; 419/14; 419/57; 419/60; 428/547; 428/548; 428/698

(58) Field of Classification Search ..... 428/547, 428/698, 699, 548; 419/57, 60, 14; 75/236, 75/240

See application file for complete search history.

(56) References Cited

U.S. PATENT DOCUMENTS 4,548,786 A * 10/1985 Yohe ..... 419/29
5,451,469 A * 9/1995 Gustafson et al. ..... 428/548
5,914,181 A * 6/1999 Uchino et al. ..... 428/216
6,228,484 B1 * 5/2001 Willert-Porada et al. ... 428/336
6,638,474 B1 * 10/2003 Liu et al. ..... 419/14
6,660,329 B1 * 12/2003 Liu et al. ..... 427/249.13
6,761,750 B1 * 7/2004 Zackrisson et al. ..... 75/241
2002/0114981 A1 8/2002 Andersson et al.
2003/0211366 A1 * 11/2003 Ruppi et al. ..... 428/698
2004/0009088 A1 1/2004 Glatzle et al.
2004/0197582 A1 * 10/2004 Larsson et al. ..... 428/472

FOREIGN PATENT DOCUMENTS

EP 0 560 212 A1 9/1993
EP 1 348 779 A1 10/2003

OTHER PUBLICATIONS

Walter Lengauer, et al., "Functionally graded hardmetals", Journal of Alloys and Compounds, vol. 338, No. 1-2, XP-004349178, May 16, 2002, pp. 194-212.

* cited by examiner

*Primary Examiner*—Ngoclan T. Mai
(74) *Attorney, Agent, or Firm*—Oblon, Spivak, McClelland, Maier & Neustadt, P.C.

(57) ABSTRACT

A cemented carbide comprises a binder phase consisting essentially of an iron family metal, a first hard phase consisting essentially of WC having a hexagonal crystal structure, and a second hard phase consisting essentially of one or more types of a compound of a metal or metals of group 4, 5 or 6 of the periodic table having an NaCl-type cubic crystal structure. The cemented carbide is formed by a surface region with a thickness of 2 to 50 μm consisting of the binder phase and the first hard phase, and an inner region present underneath the surface region consisting of the binder phase, the first hard phase and the second hard phase. A ratio of an average grain size of the first hard phase in the surface region to an average grain size of the first hard phase in the inner region is 1 or less, and a ratio of an area of the binder phase in the surface region to an area of the binder phase in the inner region is greater than 1.

16 Claims, No Drawings

CEMENTED CARBIDE, COATED CEMENTED CARBIDE MEMBER AND PRODUCTION PROCESSES OF THE SAME

BACKGROUND OF THE INVENTION

The present invention relates to a cemented carbide and a coated cemented carbide member, and more particularly, to a cemented carbide for a coated cemented carbide cutting tool capable of imparting superior wear resistance and chipping resistance to a tool that machines various types of material to be machined, such as steel, cast iron, heat-resistant alloys and non-ferrous metals, and a coated cemented carbide member in which a hard coating layer is coated onto a surface of the cemented carbide.

In a coated cemented carbide cutting tool of the prior art, numerous proposals have been made to improve the opposite properties of wear resistance and chipping resistance while also improving cutting performance. One of these proposes a cemented carbide substrate having a surface region free of NaCl-type cubic crystal structure grains consisting of one or more types of a compound of a metal or metals of group 4, 5 or 6 of the periodic table, such as carbide, nitride or carbonitride (β-free layer) (J. of Japan Institute of Metals, Vol. 45 (1981), p.95). However, since a WC phase of the surface region of this cemented carbide substrate is consisting of coarse grains, resulting in large irregularities in the surface, and an amount of an iron family metal at the boundary between the surface region and the inner region decreases considerably, chipping resistance is not significantly improved while wear resistance is remarkably decreased.

On the other hand, Japanese Unexamined Patent Publication No. 2002-167640 discloses a coated cemented carbide member in which metal elements that form compounds of a metal or metals of group 4, 5 and 6 of the periodic table are nearly uniformly distributed in the surface region, although the metal elements excluding tungsten (W) are decreased in the surface region more than in the inner region of the substrate.

In addition, Japanese Unexamined Patent Publication No. 1995-180071 discloses a high-strength coated alloy comprising a cemented carbide substrate consisting of a three-layer structure. A first layer with a thickness of 0.5 to 5 μm comprises a WC phase, an NaCl-type cubic crystal structure phase consisting of carbide or carbonitride of a metal or metals of group 4, 5 or 6 of the periodic table and an iron family metal. A second layer with a thickness of 5 to 30 μm comprises the WC phase and a layer that is richer in the iron family metal than the inner substrate. A third layer with a thickness of 10 to 50 μm comprises the WC phase, the NaCl-type cubic crystal structure phase and a layer that is more deficient in the iron family metal than the inner substrate.

In the cemented carbide or the coated cemented carbide member, the NaCl-type cubic crystal structure phase having lower toughness than the WC phase is present in the surface region directly below the coating layer, resulting in improvement of wear resistance but decrease in chipping resistance.

SUMMARY OF THE INVENTION

In this manner, cemented carbide or coated cemented carbide substrates of the prior art did not always satisfy recent requirements with increasingly severe cutting conditions for high-performance cutting processing. Therefore, in consideration of these circumstances, the object of the present invention is to provide a cemented carbide having both superior wear resistance and chipping resistance that is used in cutting tools for various types of materials to be machined, such as steel, cast iron, heat-resistant alloys and non-ferrous metals, and a coated cemented carbide member in which a hard coating layer is coated onto the surface of this cemented carbide.

As a result of conducting extensive studies on improving both chipping resistance and wear resistance in cutting tools made of coated cemented carbide, the present inventors have found followings in a cemented carbide for a coated cemented carbide member comprising a surface region consisting of a WC phase and an iron family metal phase, and an inner region present underneath the surface region consisting of the WC phase, the iron family metal phase and a phase consisting of one or more types of a compound of a metal or metals of group 4, 5 or 6 of the periodic table having an NaCl-type cubic crystal structure: plastic deformation resistance at high temperatures of the surface region is improved by (a) preventing a grain growth of the WC phase in the surface region based on the optimizing sintering conditions, and by (b) increasing an amount of a binder phase in the surface region, which results in improvement of toughness in a vicinity of the boundary between the surface region and the inner region. These findings lead to improvement of both chipping resistance and wear resistance of a cutting tool made of coated cemented carbide, thereby leading to completion of the present invention.

The present invention provides a cemented carbide comprising a binder phase consisting essentially of an iron family metal, a first hard phase consisting essentially of WC having a hexagonal crystal structure, and a second hard phase consisting essentially of one or more types of a compound of a metal or metals of group 4, 5 or 6 of the periodic table having an NaCl-type cubic crystal structure; wherein, the cemented carbide is formed by a surface region with a thickness of 2 to 50 μm consisting of the binder phase and the first hard phase, and an inner region present underneath the surface region consisting of the binder phase, the first hard phase and the second hard phase, a ratio of an average grain size of the first hard phase in the surface region to an average grain size of the first hard phase in the inner region is 1 or less, and a ratio of an area of the binder phase in the surface region to an area of the binder phase in the inner region is greater than 1.

DESCRIPTION OF THE PREFERRED EMBODIMENTS

The cemented carbide for a coated cemented carbide cutting tool in the present invention is comprising a binder phase consisting essentially of an iron family metal, a first hard phase consisting essentially of WC having a hexagonal crystal structure, and a second hard phase consisting essentially of one or more types of a compound of a metal or metals of group 4, 5 or 6 of the periodic table having an NaCl-type cubic crystal structure, namely carbide, nitride or carbonitride. The cemented carbide is formed by a surface region with a thickness of 2 to 50 μm consisting of the binder phase and the first hard phase, and an inner region present underneath the surface region consisting of the binder phase, the first hard phase and the second hard phase. Furthermore, as will be described later, the thickness of the surface region can be controlled by repeating a denitrification step in a vacuum or low-pressure nitrogen environment and a nitrification step in a pressurized nitrogen atmosphere.

The binder phase consisting essentially of the iron family metal is preferably present in the inner region of the cemented carbide at 2 to 20% by weight, and more preferably present at 5 to 12% by weight. If the amount of the binder phase is within this range, chipping resistance and wear resistance can be simultaneously imparted to a cutting tool made of a coated cemented carbide of the present invention. The amount of the binder phase can be controlled with the amount of the iron family metal contained in the cemented carbide.

The surface region is consisting essentially of WC phase and the iron family metal phase. Here, the iron family metal refers to iron, cobalt or nickel. The binder phase of the cemented carbide substrate is preferably cobalt for its main component in consideration of heat resistance, toughness and adhesion to a hard coating layer. A minute amount of the components of the first hard phase consisting essentially of WC and the second hard phase consisting essentially of one or more types of a compound of a metal or metals of group 4, 5 or 6 of the periodic table, namely metal elements and C and/or N, can be present in the binder phase as solid solution. The amount of solid solution in the binder phase is 1 to 20% by weight depending on the elements to be used. The binder phase refers to herein as either the iron family metal phase or the iron family metal phase in which metal elements and C and/or N of the first hard phase and/or the second hard phase are present as solid solution.

The first hard phase consisting essentially of WC is preferably present in the inner region of the cemented carbide at 75 to 95% by weight, and more preferably present at 80 to 90% by weight. The first hard phase has a hexagonal crystal structure, and a metal or metals of group 4, 5 or 6 of the periodic table may be present as solid solution in an extremely minute amount of, for example, 0.1% by weight or less.

The second hard phase consisting essentially of one or more types of a compound of a metal or metals of group 4, 5 or 6 of the periodic table having an NaCl-type cubic crystal structure, namely carbide, nitride or carbonitride, is preferably present in the inner region of the cemented carbide at 2 to 15% by weight, and more preferably present at 3 to 10% by weight. Here, the group 4 of the periodic table includes Ti, Zr and Hf, the group 5 includes V, Nb and Ta, and the group 6 includes Cr, Mo and W. Specific examples of the second hard phase include TiN, Ti(C, N), (Ti, W)(C, N), TaC, Ta(C, N), (Ti, W, Ta)(C, N), NbC, NbN, Nb(C, N), VC, VN, V(C, N), ZrC, ZrN, Zr(C, N), (Ti, W, Nb, Zr)(C, N) and (Ti, W, Nb, Cr, Mo)(C, N).

The surface region formed on the surface of the cemented carbide of the present invention has a thickness of 2 to 50 μm and comprises the binder phase consisting essentially of the iron family metal and the first hard phase consisting essentially of WC. If the thickness is within this range, both toughness and chipping resistance are greatly increased, and the propagation of cracks formed in the uppermost surface of the cutting tool is inhibited. Consequently, for a cutting tool, decreases in wear resistance accompanying plastic deformation that occurs easily in the surface region due to its low hardness can be prevented. More preferably, the thickness of the surface region is 8 to 30 μm, and even more preferably 8 to 20 μm.

In the present invention, a ratio of an average grain size of the first hard phase in the surface region to an average grain size of the first hard phase in the inner region is 1 or less. Namely, the average grain size of the first hard phase consisting essentially of WC is smaller in the surface region than in the inner region. In particular, the ratio of the first hard phase average grain sizes is preferably 0.8 to 1.0. If the ratio is 0.8 or more, the hardness of the surface region does not increase, and therefore toughness is not deteriorated since toughness is in an inverse relationship with hardness. Chipping resistance is thus improved. If the ratio is 1.0 or less, irregularities in the uppermost surface of the cemented carbide can be suppressed. For a cutting tool, localized stress concentration is thus avoided, resulting in enhancement of chipping resistance. Furthermore, since decreases in dispersability of the binder phase in the surface region can be prevented while also preventing decreases in hardness caused by increased size of the dispersed grains, wear resistance can be maintained at a high level. More preferably, the ratio of the first hard phase average grain sizes is 0.9 to 1.0.

The average grain size itself of the first hard (WC) phase of the inner region is preferably 0.5 to 10 μm, and more preferably 0.6 to 5 μm, in consideration of wear resistance and strength of the cemented carbide.

In the present invention, a ratio of an area of the binder phase in the surface region to an area of the binder phase in the inner region is greater than 1. Namely, the area of the binder phase increases in the surface region more than in the inner region. In particular, the ratio of the area of the binder phase is preferably 1.1 to 2.0. If the ratio is 1.1 or more, the propagation of cracks in the surface region is greatly suppressed, and high strength can be maintained. If the ratio is 2.0 or less, chipping resistance for a cutting tool is improved without decrease in hardness of the surface region. The ratio is more preferably 1.3 to 1.7 and even more preferably 1.3 to 1.5. The area is the value as measured by cross-sectional observation.

If the binder phase of the cemented carbide reaches a minimum in a vicinity of the boundary between the surface region and the inner region, that is the area of the binder phase in the vicinity of the boundary is smaller than the area of the binder phase of the inner region or the surface region, cracks initiated at a surface of a coated cemented carbide cutting tool can easily propagate in the vicinity of the boundary, thereby resulting in decrease in chipping resistance. The surface region may be sometimes removed by honing treatment (treatment for rounding cutting edges) that is typically performed on the cutting edge ridgelines of cutting tools. If the binder phase reaches a minimum in the vicinity of the boundary, which is located nearly directly below the hard coating layer, the effects of inhibiting the propagation of cracks initiated at the coated surface is considerably suppressed, resulting in decrease in chipping resistance. Thus, the area of the binder phase of the cemented carbide should not be a minimum in the vicinity of the boundary. The binder phase is preferably increased gradually from the vicinity of the boundary towards the uppermost surface of the surface region.

The area of the binder phase in the surface region is preferably 8 to 40% relative to an entire area of a cross-sectional observation surface. If the area is 8% or more, strength is not decreased, and if the area is 40% or less, wear resistance is not decreased. The area of the binder phase in the surface region is more preferably 10 to 35% and even more preferably 10 to 25%. The area of the binder phase in the inner region is preferably 5 to 30% relative to the entire area of a cross-sectional observation surface. If the area is 5% or more, strength is not decreased, and if the area is 30% or less, plastic deformation is not easily occurred. The area of the binder phase in the inner region is more preferably 8 to 25% and even more preferably 8 to 20%.

The cemented carbide comprising the surface region and the inner region of the present invention is characterized by the ratio of the average grain size of the first hard phase in the surface region to the average grain size of the first hard phase in the inner region being 1 or less, and the ratio of the area of the binder phase in the surface region to the area of the binder phase in the inner region being greater than 1.

This characteristic can be achieved by the components and amount of the second hard phase consisting of one or more types of a compound of a metal or metals of group 4, 5 or 6 of the periodic table, a minute amount of which is present as solid solution in the binder phase. Namely, the grain growth of the WC phase of the surface region is inhibited in a sintering process by the presence of elements that inhibit grain growth, such as Ti, Ta, Nb, Cr, Mo, V or N present in the binder phase as solid solution. Grain growth of the WC phase proceeds as a result of melting/precipitation of WC through a liquid phase of the iron family melted at a high temperature of 1300° C. or higher in the sintering process. At this time, tungsten (W), which has a low affinity with N, becomes difficult to melt if nitrogen is present in the liquid phase, thereby inhibiting WC grain growth. In addition, if an element, such as Ti, Ta, Nb, Cr, Mo, V or N is present in the liquid phase of the iron family metal, W can no longer be present in the liquid phase as solid solution, and WC grain growth is inhibited.

On the other hand, the amount and the distribution of the binder phase consisting essentially of the iron family metal in the inner region and the surface region can be controlled by the amount of NaCl-type cubic crystal structure grains of a metal or metals of group 4, 5 or 6 of the periodic table, and the amount of solid solution of the metal and C and/or N in the binder phase. Moreover, the area of the binder phase of the iron family metal is gradually increased due to a rise in the solidification temperature of the liquid phase in the cooling step of the sintering process accompanying increase in the amount of solid solution of the metal and C and/or N in the liquid phase of the iron family metal.

Thus, in the cemented carbide of the present invention, the amount of solid solution of the metal and C and/or N in the liquid phase can be controlled in the surface region. Consequently, in order to produce the cemented carbide having the surface region of a thickness of 2 to 50 μm with the iron family metal and the first hard phase, and the inner region consisting of the iron family metal, the first hard phase and the second hard phase, and wherein the ratio of the first hard phase average grain sizes and the ratio of the area of the binder phase are both controlled to be within the ranges of the present invention, the amount of solid solution of the metal and C and/or N in the liquid phase of the surface region is decreased more than that of the inner region in the sintering process.

This can be realized by using a method described below. The amount of solid solution of the metal and C and/or N in the liquid phase of the iron family metal is repeatedly increased and decreased and then finally decreased in the surface region more than in the inner region in the sintering process at a temperature of about 1300° C. or higher. More specifically, the atmosphere is alternately repeated between a denitrifying atmosphere in a vacuum and a pressurized nitrifying atmosphere at a nitrogen partial pressure of, for example, 200 to 5000 Pa at a temperature of 1350 to 1500° C., and preferably 1380 to 1450° C., at which the diffusion rate of the metal and C and/or N of the surface region is large. In addition, the amount of solid solution can be also controlled by repeating a denitrification step in a low-pressure nitrogen atmosphere at a nitrogen partial pressure of, for example, 50 Pa or less instead of a vacuum, and the nitrification step in a pressurized nitrogen atmosphere.

The longer the retention time in the denitrifying atmosphere, the thickness of the surface region grows in proportion to the square root of the retention time. The greater the amount of nitrogen removed from the surface of the sintered body, namely in the vacuum atmosphere, under the conditions of low nitrogen partial pressure atmosphere or the greater the amount of nitrogen in the green compact, or the smaller the amount of the second hard phase, the faster the growth rate of the surface region. However, prolonging the retention time accelerates grain growth of the WC phase of the surface region, resulting in the larger average grain size than the WC phase of the inner region. The retention time in the denitrifying atmosphere is thus adjusted according to the degree of denitrification. A retention time of 1 to 10 minutes is preferable in consideration of increases in thickness of the surface region and prevention of grain growth of the WC phase.

On the other hand, retention in the nitrifying atmosphere stops growth of the surface region while also inhibiting grain growth of the WC phase. However, increases in retention time cause the formation of the second hard phase having the NaCl-type cubic crystal structure in the uppermost surface of the surface region. The retention time in the nitrifying atmosphere is thus adjusted according to the degree of nitrification. It is preferably from 1 to 10 minutes in consideration of inhibiting grain growth of the WC phase as well as inhibiting the formation of the second hard phase having the NaCl-type cubic crystal structure.

In order to ultimately control the ratio of the first hard phase average grain sizes and the ratio of the area of the binder phase to within the ranges of the present invention, the atmosphere is repeatedly changed between a denitrifying atmosphere and a nitrifying atmosphere. The thickness of the surface region can be controlled with the difference between the total time of the denitrification step and the total time of the nitrification step, namely with number of repetitions multiplying with the difference between the total time of the denitrification step and the total time of the nitrification step. The number of repetitions of the denitrification step and the nitrification step varies according to the degree of denitrification and the degree of nitrification. Each step is preferably alternately carried out 3 to 15 times.

Moreover, a coated cemented carbide member having improved wear resistance and surface lubricity can be obtained by coating a hard coating layer onto the surface of the cemented carbide of the present invention. The hard coating layer can be a single layer or a multilayer of one or more materials selected from the group consisting of a metal compound, a metal alloy compound, diamond and ceramics.

The coated cemented carbide member of the present invention is suited to a cutting tool, such as a cutting tip, drill, reamer or end mill, which is used to machine various types of materials to be machined, such as steel, cast iron, heat-resistant alloys and non-ferrous metals. In particular, the use of a coated cemented carbide of the present invention is particularly preferable for a cutting tool to suppress the propagation of cracks formed in the coated surface during cutting, as well as to inhibit plastic deformation of the tool surface when exposed to high temperatures.

The first hard phase consisting essentially of WC having a hexagonal crystal structure and the second hard phase consisting essentially of compound of one or more types of a carbide, nitride or carbonitride of a metal or metals of group 4, 5 or 6 of the periodic table can be respectively distinguished by observing the microstructure of a cross-section of the cemented carbide with an optical microscope or SEM. The thickness of the surface region can be measured from the thickness of a portion in which the second hard phase is not present by grinding the sample at an angle of 90° relative to the sample surface.

The average grain size of the WC phase can be measured by image analysis of the cross-sectional microstructure by SEM. Here, the average grain size is measured using the following equation (1):

$$dm=(4/\pi)\times(NL/NS) \quad (1)$$

(wherein dm is the average grain size, π is the ratio of the circumference of a circle to its diameter, NL is the number of WC per unit length that are hit by an arbitrary straight line on the cross-sectional structure, and NS is the number of WC contained in an arbitrary unit area).

The area of the binder phase consisting essentially of the iron family metal can be measured along the surface region to the inner region by inclined grinding the cemented carbide to an angle of 4 degrees relative to the sample surface, and then performing image analysis on the SEM structure of a field in which the inclined ground surface is magnified by a factor of 5000.

EXAMPLES

The compositions shown in Table 1 were blended using each of the commercially available powders having an average grain size of 0.1 to 4 μm of WC, Ti(C, N), TaC, NbC, VC, ZrC and Co. The blended powder, acetone and balls were then placed in a stainless steel mixing container, and ball-milling were carried out for 20 hours. After a small amount of paraffin was added to the resulting mixed powder, it was press formed until CNMG120408 (shape defined in JIS standards) was obtained. After removing the paraffin by heating at 450° C., the green compact by the press forming was heated to 1400° C. in a vacuum at 13 Pa. The cemented carbides of Examples 1 through 5 and Comparative Examples 6 through 10 were then sintered while holding at the conditions shown in Tables 2 and 3. A coating of TiN, Ti(C, N) or $Al_2O_3$ with a thickness of 12 μm was then coated by CVD onto the surfaces of the cemented carbides of these examples and comparative examples to obtain cutting tools made of coated cemented carbide of Examples 1 through 5 and Comparative Examples 6 through 10.

The depth of the surface region, average grain size of the WC phase, proportion of Co that occupies the surface region and the inner region (area of binder phase), and the presence of a minimum value for the area of the Co binder phase in the vicinity of the boundary between the surface region and the inner region were measured by the cross-sectional microstructures and observation of cross-sections and inclined surfaces of Examples 1 through 5 and Comparative Examples 6 through 10. Those results are shown in Table 4.

In addition, cutting tests were conducted under the conditions indicated in (A) and (B) below using the cutting tools of Examples 1 through 5 and Comparative Examples 6 through 10. Those results are shown in Table 5.

(A) Wear Resistance Test
- Material to be tested: S53C (HB=270)
- Shape of tip: CNMG120408, with tip breaker
- Cutting speed: 200 m/min
- Cutting depth: 2 mm
- Feed rate: 0.25 mm/rev
- Tool service life standard: time until corner wear reaches 0.3 mm (B) Chipping Resistance Test
- Material to be tested: S45C, containing four grooves
- Shape of tip: CNMG120408, with tip breaker
- Cutting speed: 150 m/min
- Cutting depth: 2 mm
- Feed rate: 0.3 mm/rev
- Tool service life standard: until chipping occurs (average of three specimens)

TABLE 1

| | Sample | Blended composition (wt %) | | | | | | | N content |
|---|---|---|---|---|---|---|---|---|---|
| | No. | WC | Ti (C, N) | TaC | NbC | VC | ZrC | Co | (wt %) |
| Examples | 1 | 83.8 | 3 | 0 | 5 | 0 | 0.2 | 8 | 0.21 |
| | 2 | 90.0 | 2 | 0 | 3 | 0 | 0 | 5 | 0.14 |
| | 3 | 82.8 | 3 | 4 | 0 | 0.2 | 0 | 10 | 0.21 |
| | 4 | 76.7 | 4 | 4 | 0 | 0 | 0.3 | 15 | 0.28 |
| | 5 | 86.0 | 3 | 0 | 3 | 0 | 0 | 8 | 0.21 |
| Comparative Examples | 6 | 83.8 | 3 | 0 | 5 | 0 | 0.2 | 8 | 0.21 |
| | 7 | 90.0 | 2 | 0 | 3 | 0 | 0 | 5 | 0.14 |
| | 8 | 82.8 | 3 | 4 | 0 | 0.2 | 0 | 10 | 0.21 |
| | 9 | 76.7 | 4 | 4 | 0 | 0 | 0.3 | 15 | 0.28 |
| | 10 | 86.0 | 3 | 0 | 3 | 0 | 0 | 8 | 0.21 |

Note:
The N content shown in the table indicates the value determined by analyzing the amount of N in the green compact.

TABLE 2

| | | Conditions during retention at 1400° C. | | | | Total |
|---|---|---|---|---|---|---|
| | Sample No. | Step No. | Atmosphere | Pressure (Pa) | Retention time (min) | retention time (min) |
| Examples | 1 | Va1 | In a vacuum | 13 | 5 | 70 |
| | | Na1 | In $N_2$ | 1,300 | 5 | |
| | | Va2 | Denitrification step a of Van (n = 2–6) under | | | |
| | | Na2 | same conditions as Va1 and nitrification step a | | | |
| | | . | of Nan (n = 2–6) under same conditions as Na1 | | | |
| | | . | alternately repeated five times each. | | | |
| | | . | | | | |
| | | Va7 | In a vacuum | 13 | 5 | |
| | | Na7 | In $N_2$ | 1,300 | 5 | |
| | 2 | Vb1 | In $N_2$ | 26 | 8 | 63 |
| | | Nb1 | In $N_2$ | 3,900 | 3 | |
| | | Vb2 | Denitrification step b of Vbn (n = 2–4) under | | | |
| | | Nb2 | same conditions as Vb1 and nitrification step b | | | |
| | | . | of Nbn (n = 2–4) under same conditions as Nb1 | | | |
| | | . | alternately repeated three times each. | | | |
| | | . | | | | |
| | | Vb5 | In $N_2$ | 26 | 8 | |
| | | Nb5 | In $N_2$ | 3,900 | 3 | |

TABLE 2-continued

| Sample No. | Step No. | Atmosphere | Pressure (Pa) | Retention time (min) | Total retention time (min) |
|---|---|---|---|---|---|
| | | Conditions during retention at 1400° C. | | | |
| | Vb6 | In $N_2$ | 26 | 8 | |
| 3 | Vc1 | In a vacuum | 13 | 3 | 64 |
| | Nc1 | In $N_2$ | 260 | 5 | |
| | Vc2 | Denitrification step c of Vcn (n = 2–7) under | | | |
| | Nc2 | same conditions as Vc1 and nitrification step c | | | |
| | . | of Ncn (n = 2–7) under same conditions as Nc1 | | | |
| | . | alternately repeated six times each. | | | |
| | . | | | | |
| | Vc8 | In a vacuum | 13 | 3 | |
| | Nc8 | In $N_2$ | 260 | 5 | |
| 4 | Vd1 | In a vacuum | 13 | 2 | 60 |
| | Nd1 | In $N_2$ | 650 | 3 | |
| | Vd2 | Denitrification step d of Vdn (n = 2–11) under | | | |
| | Nd2 | same conditions as Vd1 and nitrification step d | | | |
| | . | of Ndn (n = 2–11) under same conditions as | | | |
| | . | Nd1 alternately repeated ten times each. | | | |
| | . | | | | |
| | Vd12 | In a vacuum | 13 | 2 | |
| | Nd12 | In $N_2$ | 650 | 3 | |
| 5 | Ve1 | In a vacuum | 13 | 2 | 34 |
| | Ne1 | In $N_2$ | 1,300 | 2 | |
| | Ve2 | Denitrification step e of Ven (n = 2–7) under | | | |
| | Ne2 | same conditions as Ve1 and nitrification step d | | | |
| | . | of Nen (n = 2–7) under same conditions as Ne1 | | | |
| | . | alternately repeated six times each. | | | |
| | . | | | | |
| | Ve8 | In a vacuum | 13 | 2 | |
| | Ne8 | In $N_2$ | 1,300 | 2 | |
| | Ve9 | In a vacuum | 13 | 2 | |

TABLE 3

| | Sample No. | Step No. | Atmosphere | Pressure (Pa) | Retention time (min) | Total retention time (min) |
|---|---|---|---|---|---|---|
| | | Conditions during retention at 1400° C. | | | | |
| Comparative Examples | 6 | Vf1 | In a vacuum | 13 | 40 | 40 |
| | 7 | Vg1 | In a vacuum | 13 | 50 | 70 |
| | | Ng2 | In $N_2$ | 40,000 | 20 | |
| | 8 | Nh1 | In $N_2$ | 140 | 30 | 30 |
| | 9 | Vi1 | In a vacuum | 13 | 15 | 60 |
| | | Ni1 | In $N_2$ | 1,300 | 15 | |
| | | Vi2 | In a vacuum | 13 | 15 | |
| | | Ni2 | In $N_2$ | 1,300 | 15 | |
| | 10 | Vj1 | In a vacuum | 13 | 60 | 60 |

TABLE 4

| | Sample No. | Thickness of surface region (μm) | Average grain size of WC phase of inner region (μm) | Ratio of average grain size of WC phase of surface region to inner region | Area of binder phase of inner region (%) | Ratio of area of binder phase of surface region to inner region | Whether or not area of binder phase reaches a minimum in vicinity of boundary between inner region and surface region |
|---|---|---|---|---|---|---|---|
| Examples | 1 | 12 | 3.2 | 0.9 | 11.9 | 1.5 | No |
| | 2 | 15 | 2.8 | 1.0 | 7.9 | 1.3 | No |
| | 3 | 23 | 1.3 | 0.8 | 15.3 | 1.6 | No |
| | 4 | 9 | 4.0 | 0.9 | 21.8 | 1.8 | No |
| | 5 | 28 | 2.5 | 0.8 | 12.1 | 1.4 | No |
| Comparative Examples | 6 | 16 | 3.0 | 1.2 | 11.9 | 1.4 | Yes |
| | 7 | 13(*1) | 2.8 | 1.1 | 7.9 | 1.5 | Yes |
| | 8 | 0 | 1.1 | — | 15.4 | — | No |
| | 9 | 10 | 3.9 | 1.1 | 21.8 | 1.0 | No |
| | 10 | 16 | 2.7 | 1.3 | 12.1 | 1.4 | Yes |

(*1)NaCl-type cubic crystal structure layer of 1 μm present on the uppermost surface of the surface region.

TABLE 5

| | Sample No. | Wear Resistance Cutting time until 0.3 mm of corner wear (minutes) | Chipping Resistance Average no. of impacts of three specimens until chipping |
|---|---|---|---|
| Examples | 1 | 43 | 19541 |
| | 2 | 54 | 16823 |
| | 3 | 32 | 27083 |
| | 4 | 22 | No chipping up to 30000 impacts |
| | 5 | 37 | 26913 |
| Comparative Examples | 6 | 35 | 11027 |
| | 7 | 38 (Coating separation and plastic deformation occurred) | 130 |
| | 8 | 22 | 3342 |
| | 9 | 17 | 8513 |
| | 10 | 27 | 13543 |

As shown in Table 4, in the coated cemented carbide members of Examples 1 through 5 produced by the sintering conditions shown in Tables 2, the ratio of the average grain size of the first hard phase of the surface region to that of the inner region is within the range of 0.8 to 1.0, and the ratio of the area of the binder phase of surface region to that of the inner region is within the range of 1.3 to 1.8. The amount of the binder phase also does not reach a minimum at the boundary between the inner region and surface region. Consequently, these coated cemented carbide members have superior wear resistance and chipping resistance in which the time until the corner wear of the cutting tool reaches 0.3 mm is 22 minutes or more, and the number of impacts until chipping occurs in terms of the average of three specimens exceeds 15,000 impacts.

In the coated cemented carbide members of Comparative Examples 6 through 10 produced by the sintering conditions shown in Tables 3, the ratios of the first hard phase average grain sizes in Comparative Examples 6 and 10, in which all sintering treatment was performed in a vacuum, were 1.2 and 1.3, respectively. This indicates that the grain size in the WC phase becomes larger. The amount of the binder phase at the boundary reaches a minimum, resulting in the decrease in chipping resistance. In Comparative Example 7, the NaCl-type cubic crystal structure phase is formed in the uppermost surface of the surface region, which deteriorates toughness in the uppermost surface. The grain size of the WC phase is increased and the amount of the binder phase reaches a minimum at the boundary. The hard coating layer is separated and the plastic deformation is occurred, and chipping resistance is thus decreased to an extremely low level. In Comparative Example 8, the surface region is not formed due to sintering treatment being carried under conditions of a low nitrogen partial pressure, thereby resulting in a low level of chipping resistance. In Comparative Example 9, although sintering is repeated twice in a vacuum and in at a high nitrogen partial pressure, since the retention times in both the denitrification and nitrification steps are long, both wear resistance and chipping resistance are inadequate due to increased grain size of the WC phase and decreased proportion of the surface area of the binder phase.

A comparison between Examples 1 through 5 and Comparative Examples 6 through 10 reveals that Examples 1 through 5 have superior chipping resistance to Comparative Examples 6 through 10. In particular, Examples 1 and 2 are superior to Comparative Examples 6 through 10 both in terms of wear resistance and chipping resistance.

EFFECTS OF THE INVENTION

As has been described above, a cutting tool made of coated cemented carbide of the present invention has both superior wear resistance and chipping resistance as compared with cutting tools made of coated cemented carbide of the prior art. Thus, for a cutting tool, the cutting tool made of coated cemented carbide of the present invention offers the significant effects of inhibiting the propagation of cracks in the surface region as well as inhibiting plastic deformation of the surface region at high temperatures.

What is claimed is:

1. A cemented carbide comprising:

a binder phase consisting essentially of an iron family metal, a first hard phase consisting essentially of WC having a hexagonal crystal structure, and a second hard phase consisting essentially of one or more types of a compound of a metal or metals of group 4, 5 or 6 of the periodic table having an NaCl cubic crystal structure; wherein, the cemented carbide is formed by a surface region with a thickness of 2 to 50 μm consisting of the binder phase and the first hard phase, and an inner region present underneath the surface region consisting of the binder phase, the first hard phase and the second hard phase, a ratio of an average grain size of the first hard phase in the surface region to an average grain size of the first hard phase in the inner region is less than 1, and a ratio of an area of the binder phase in the surface region to an area of the binder phase in the inner region is greater than 1.

2. A cemented carbide according to claim 1, wherein the ratio of the average grain size of the first hard phase in the surface region to the average grain size of the first hard phase in the inner region is not less than 0.8 and less than 1.0, and the ratio of the area of the binder phase in the surface region to the area of the binder phase in the inner region is 1.1 to 2.0.

3. A cemented carbide according to claim 1, wherein the area of the binder phase in the surface region increases gradually from a boundary between the inner region and the surface region towards an uppermost surface of the surface region.

4. A coated cemented carbide member comprising a hard coating layer coated onto a surface of a cemented carbide according to claim 1.

5. A coated cemented carbide member comprising a hard coating layer coated onto a surface of a cemented carbide according to claim 2.

6. A coated cemented carbide member comprising a hard coating layer coated onto a surface of a cemented carbide according to claim 3.

7. A coated cemented carbide member according to claim 4, wherein the hard coating layer is a single layer or a multilayer coating of one or more materials selected from the group consisting of a metal compound, a metal alloy compound, diamond and ceramics.

8. A coated cemented carbide member according to claim 5, wherein the hard coating layer is a single layer or a multilayer coating of one or more materials selected from the group consisting of a metal compound, a metal alloy compound, diamond and ceramics.

9. A coated cemented carbide member according to claim 6, wherein the hard coating layer is a single layer or a multilayer coating of one or more materials selected from the group consisting of a metal compound, a metal alloy compound, diamond and ceramics.

10. A method for producing a cemented carbide comprising the steps of:

(A) preparing a mixture comprising 2 to 20% by weight of an iron family metal, 75 to 95% by weight of WC, and 3 to 10% by weight of one or more types of a compound of a metal or metals of group 4, 5 or 6 of the periodic table to a total of 100% by weight;

(B) heating the mixture in a vacuum or in an atmosphere having a nitrogen partial pressure of 50 Pa or less to a predetermined temperature within the range of 1350 to 1500° C.;

(C) sintering the mixture repeatedly for 3 to 15 times at the predetermined temperature for 1 to 10 minutes in the vacuum or in the atmosphere having a nitrogen partial pressure of 50 Pa or less and then in an atmosphere having a nitrogen partial pressure of 200 to 5,000 Pa; and, (D) cooling the mixture to a normal temperature.

11. A method for producing a cemented carbide according to claim 10, wherein the mixture is further sintered after the step (C) for 1 to 10 minutes in the vacuum or in the atmosphere having a nitrogen partial pressure of 50 Pa or less at the predetermined temperature.

12. A method for producing a coated cemented carbide member, further comprising the step (E) coating a hard coating layer onto a surface of a cemented carbide obtained by a method according to claim 10.

13. A method for producing a coated cemented carbide member, further comprising the step (E) coating a hard coating layer onto a surface of a cemented carbide obtained by a method according to claim 11.

14. A method for producing a coated cemented carbide member according to claim 12, wherein the hard coating layer is a single layer or a multilayer coating of one or more materials selected from the group consisting of a metal compound, a metal alloy compound, diamond and ceramics.

15. A method for producing a coated cemented carbide member according to claim 13, wherein the hard coating layer is a single layer or a multilayer coating of one or more materials selected from the group consisting of a metal compound, a metal alloy compound, diamond and ceramics.

16. A cemented carbide comprising:

a binder phase consisting essentially of an iron family metal, a first hard phase consisting essentially of WC having a hexagonal crystal structure, and a second hard phase consisting essentially of one or more types of a compound of a metal or metals of group 4, 5 or 6 of the periodic table having an NaCl cubic crystal structure; wherein, the cemented carbide is formed by a surface region with a thickness of 2 to 50 μm consisting of the binder phase and the first hard phase, and an inner region present underneath the surface region consisting of the binder phase, the first hard phase and the second hard phase, a ratio of an average grain size of the first hard phase in the surface region to an average grain size of the first hard phase in the inner region is not less than 0.8 and less than 1, and a ratio of an area of the binder phase in the surface region to an area of the binder phase in the inner region is greater than 1.

* * * * *